United States Patent [19]

Greven et al.

[11] 4,112,730

[45] Sep. 12, 1978

[54] CARRIAGE DRAWING MACHINE FOR UNIFORMLY DRAWING ELONGATED MATERIAL TO BE DRAWN

[75] Inventors: Johann Greven, Aachen, Germany; Johann Mostert, Eupen, Belgium

[73] Assignee: Schumag Schumacher Metallwerke Gesellschaft mit beschrankter Haftung, Aachen, Germany

[21] Appl. No.: 828,884

[22] Filed: Aug. 29, 1977

[30] Foreign Application Priority Data

Apr. 15, 1977 [DE] Fed. Rep. of Germany ..... 2716657

[51] Int. Cl.[2] ..... B21C 1/28

[52] U.S. Cl. ..... 72/290

[58] Field of Search ..... 72/287, 290, 291, 293, 72/301, 302, 305, 307; 24/263 SW, 263 R; 269/85, 104, 154, 217, 218, 234, 259, 270, 279, 280

[56] References Cited

U.S. PATENT DOCUMENTS

| | | | |
|---|---|---|---|
| 2,380,277 | 7/1945 | Weightman | 72/287 |
| 2,492,544 | 12/1949 | Vetter | 72/287 |
| 3,416,350 | 12/1968 | Eagleson et al. | 72/293 |
| 3,690,133 | 9/1972 | Hilgers | 72/290 |
| 3,712,104 | 1/1973 | Goeke | 72/290 |

*Primary Examiner*—Michael J. Keenan

*Attorney, Agent, or Firm*—Herbert L. Lerner

[57] ABSTRACT

In a carriage drawing machine for uniformly drawing elongated material to be drawn, having two drawing carriages reciprocatingly displaceable in mutually opposite directions, a drawing jaw vise on each carriage for alternately gripping the material to be drawn, each of the vises having two drawing jaws held in a housing by a wedge structure with bearing rollers interposed which serves to self-lock during the drawing, both of said drawing jaw vises being disposed to receive and simultaneously draw two bars of the material to be drawn, at least one of the two drawing jaws being engageable in common with both of the bars, and including an equalizing support in association with the other of the two drawing jaws.

14 Claims, 20 Drawing Figures

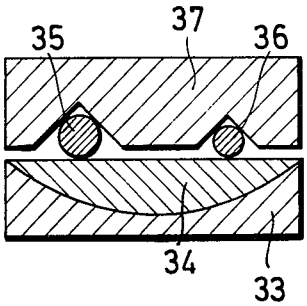
FIG. 9a
FIG. 9b
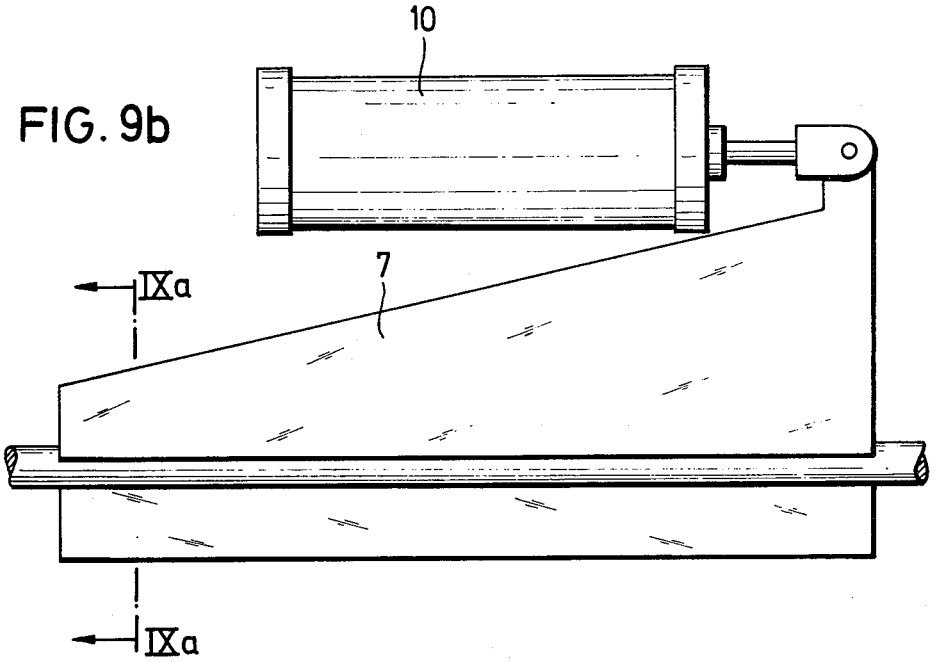
FIG. 9c
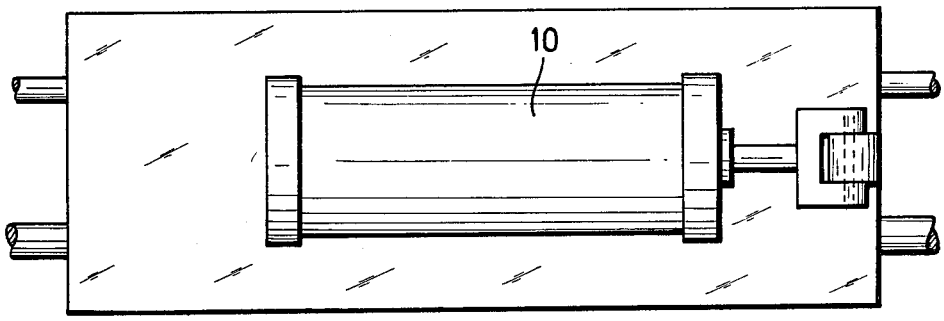

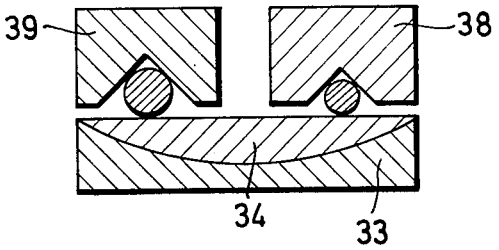
FIG. 10a
FIG. 10b
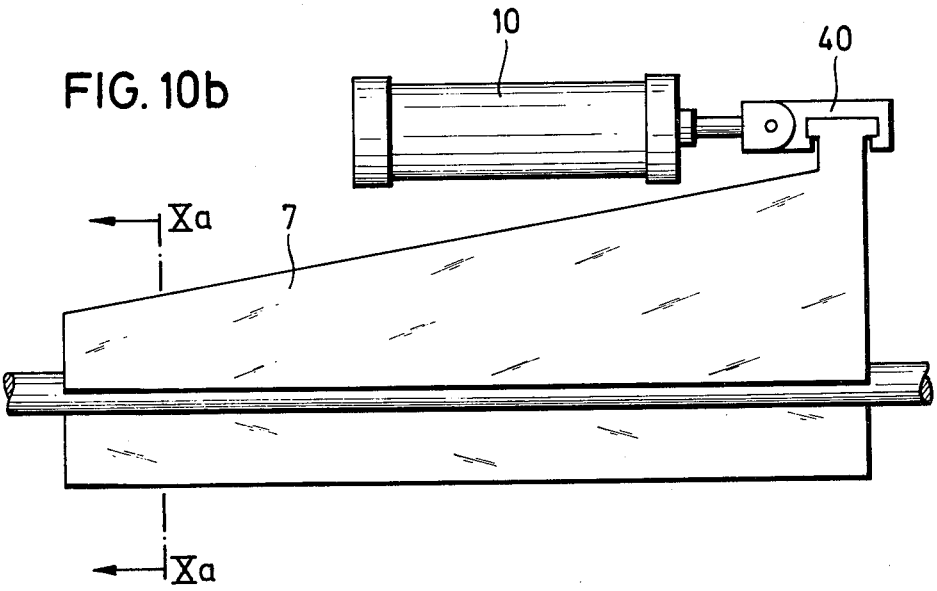
FIG. 10c
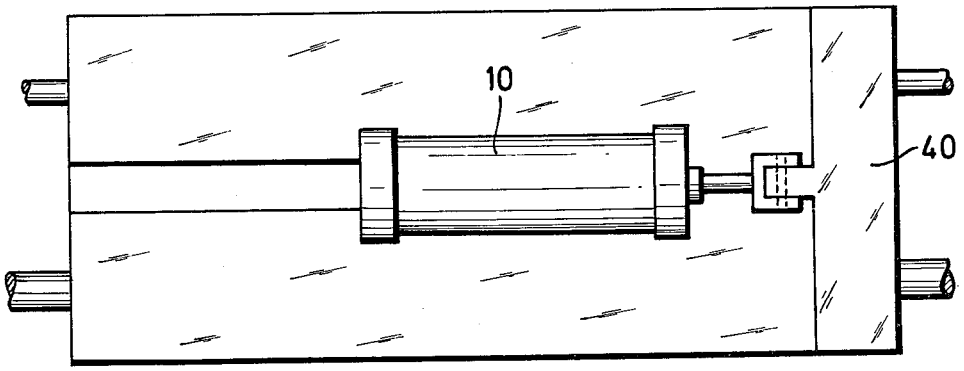

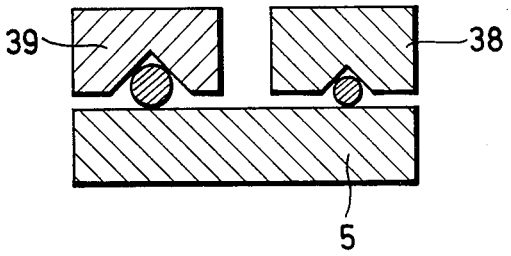
FIG. 11a
FIG. 11b
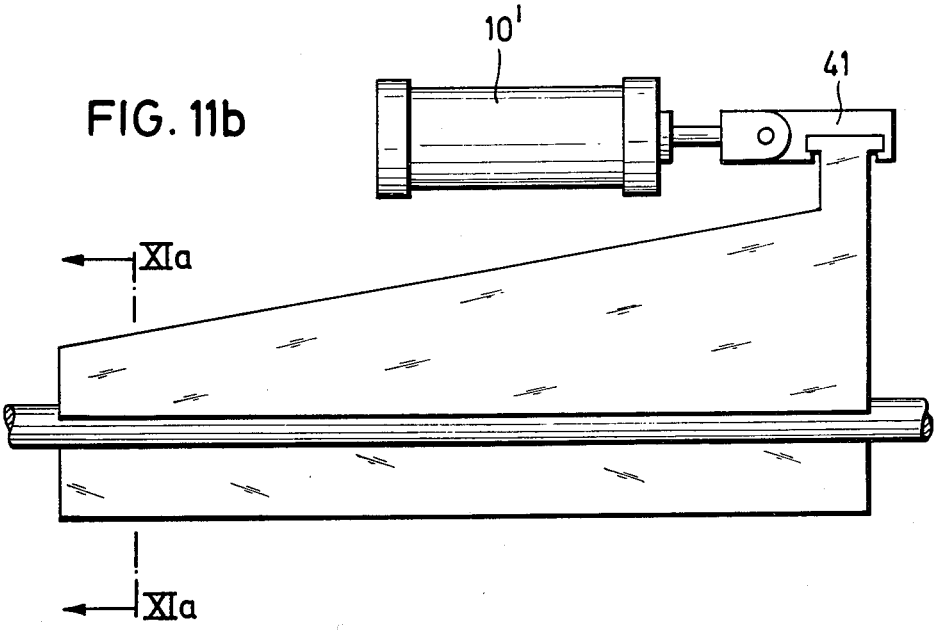
FIG. 11c
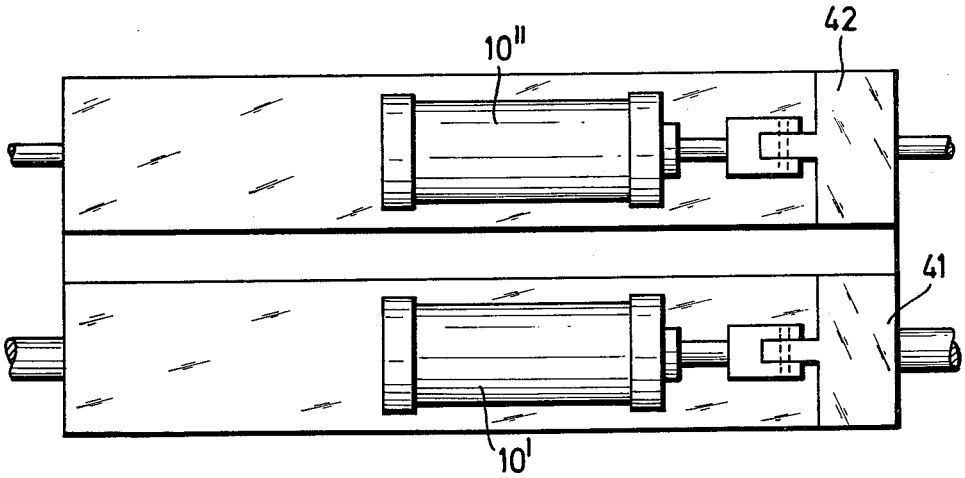

CARRIAGE DRAWING MACHINE FOR UNIFORMLY DRAWING ELONGATED MATERIAL TO BE DRAWN

The invention relates to a carriage drawing machine for uniformly drawing elongated material to be drawn, having two drawing carriages reciprocatingly displaceable in mutually opposite directions, a drawing jaw vise on each carriage for alternatingly gripping the material to be drawn, each of the vises having two drawing jaws held in a housing by a wedge structure with bearing rollers interposed which serves to self-lock during the drawing. A carriage drawing machine of this general type is the subject of a patent application by one of us filed concurrently herewith U.S. patent application Ser. No. 828,901.

It is an object of the invention to provide a carriage drawing machine of the foregoing type which affords an increase in production quantity by simultaneously drawing two strands or rods with a drawing carriage pair.

With the foregoing and other objects in view, there is provided, in accordance with the invention, a carriage drawing machine for uniformly drawing elongated material to be drawn, having two drawing carriages reciprocatingly displaceable in mutually opposite directions, a drawing jaw vise on each carriage for alternately gripping the material to be drawn, each of the vises having two drawing jaws held in a housing by a wedge structure with bearing rollers interposed which serves to self-lock during the drawing, both of the drawing jaw vises disposed to receive and simultaneously draw two bars of the material to be drawn, at least one of the two drawing jaws being engageable in common with both of the bars, and including an equalizing support in association with the other of the two drawing jaws.

Through the simultaneous drawing of two strands or rods, the attainable production quantity is considerably increased. Due to the employment of one common drawing jaw for both strands or rods, the construction is simplified and reliable. Due to the equalized or balanced support no mutual disturbances are produced when drawing the two strands or rods. In fact, two strands or rods of varying diameter can be drawn thereby simultaneously. Also, two strands or rods of varying cross-sectional shape can be drawn simultaneously.

In accordance with another feature of the invention, the drawing jaws are disposed relative to one another for accomodating adjacently traveling rods or strands of the material to be drawn.

In this regard, in accordance with a further feature of the invention, the drawing jaws are disposed one above the other for cooperatively gripping the material to be drawn.

In accordance with an added feature of the invention, at least one of the sides of the cooperating drawing jaws facing toward one another has shaped constructions accommodated to the profile of the rods or strands. This feature also constitutes an invention applicable to a carriage drawing machine provided for drawing only one strand or bar.

In accordance with an additional feature of the invention, the drawing jaws for both of the rods are disposed one above the other, and each thereof is engageable in common with both of the rods, one of the drawing jaws having a scale-beam mounting and having an axis extending in a direction parallel to the direction of the drawing.

The mounting or bearing like that of a scale-beam is an especially advantageous type of equalizing mounting with respect to differences in cross section for the two strands or rods to be drawn.

In accordance with yet another feature of the invention, the jaws are disposed one above the other, one of the drawing jaws being divided for the rods of material to be drawn.

In accordance with yet a further feature of the invention, the drawing jaws are disposed one above the other, and within a clamping path during take-over of the material to be drawn, the lower drawing jaw being displaceable parallel to the direction of drawing and the upper drawing jaw parallel to a wedge wall of the housing of the drawing jaw vise.

This feature of the invention permits a marked accommodation to the various requirements when drawing various types of material to be drawn.

In accordance with yet an added feature of the invention, the drawing jaws are disposed one above the other, the upper drawing jaw having a roller-shaped flat bearing member at the underside thereof, the bearing member being pivotable in a holder about an axis parallel to the direction of drawing, the bearing member having a widening at the underside thereof for gripping both of the bars to be drawn.

This feature widely permits the simultaneous drawing of two strands or bars of varying cross section. The differences in the cross section are relatively easily and reliably equalized, and both strands or bars are gripped securely.

In accordance with yet an additional feature of the invention, the widening is constructed as a separate member threadedly secured to the flat underside of the roller-shaped bearing members.

In accordance with another feature of the invention, the drawing jaws are disposed one above the other, the lower drawing jaw being constructed as a flat circular cylindrical section pivotable in a bearing trough about an axis parallel to the direction of drawing and having a width at the top thereof adequate for embodiment has the advantage of an especially flat type of construction.

In accordance with a further feature of the invention, the lower drawing jaw is adjustable in elevation. This feature is also inventively applicable to drawing machines provided for drawing only one strand or rod.

In accordance with an added feature of the invention, the vises, respectively, have a third drawing jaw fixedly disposed intermediate the other two drawing jaws, the other two drawing jaws being displaceable within a clamping path on respective wedge paths.

In accordance with an added feature of the invention, both of the sides of the cooperating drawing jaws facing towards one another are formed with rod-accommodating shaped constructions mutually complementing one another.

in accordance with a concomitant feature of the invention, the shaped constructions in both of the drawing jaws differ from one another.

Although the invention is illustrated and described herein as embodied in carriage drawing machine for uniformly drawing elongated material to be drawn, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
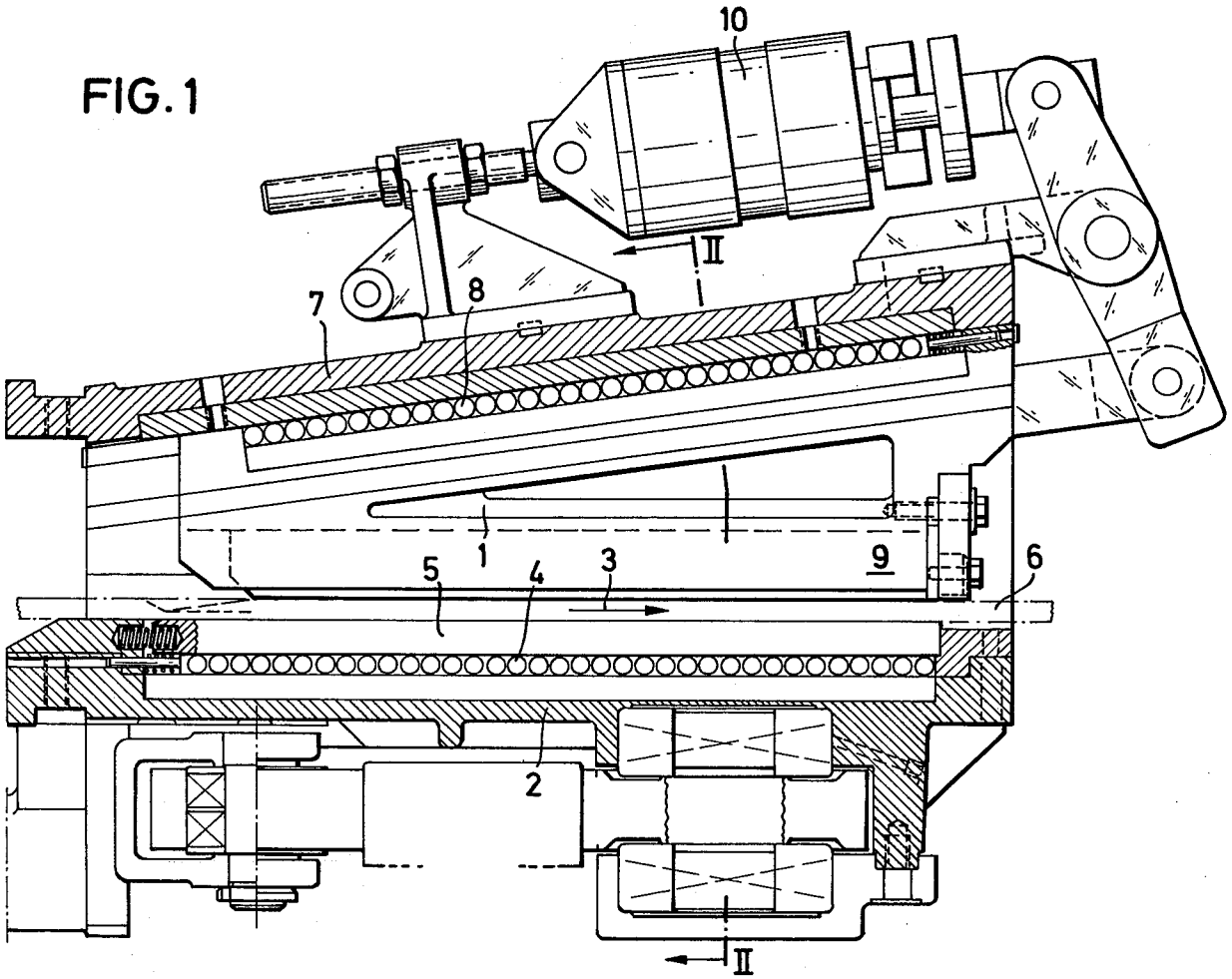
FIG. 1 is an elevational view, partly in section, of drawing jaws disposed above one another in a wedge-shaped housing.

FIGS. 9*a*, 9*b* and 9*c* are sectional, side elevational and top plan views, respectively, of a drawing jaw vise with a release control, wedge-shaped housing and drawing jaws of which the upper shaped construction and the lower exhibit a pivotable flat circular-cylindrical section;

FIG. 10*a*, 10*b* and 10*c* are views respectively similar to those of FIGS. 9*a*, 9*b* and 9*c*, of another embodiment of the invention wherein the upper jaw is divided for two elongated strands of material that are to be drawn, and a common support or bearing is provided on the housing for the drawing jaw vise.

Figure 12:
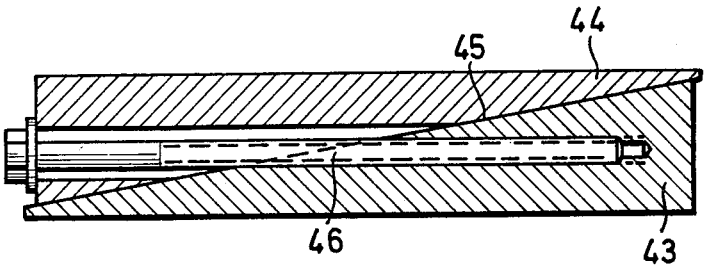
Figure 13A:
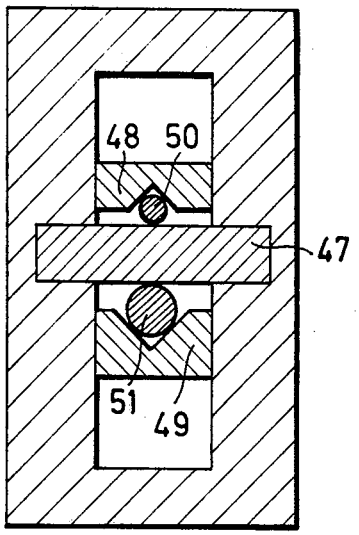
Figure 13B:
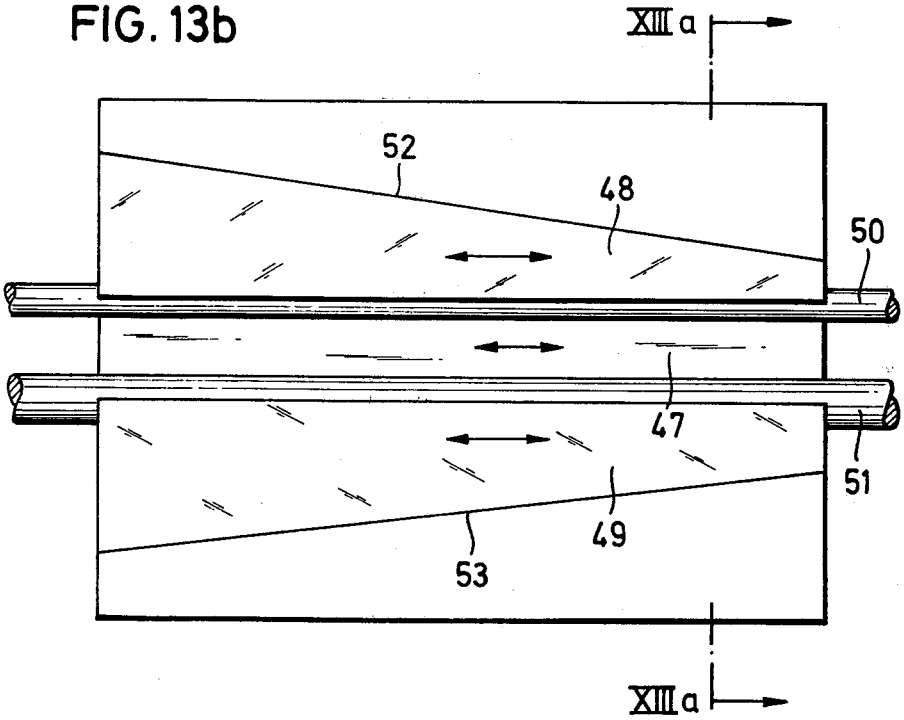

FIGS. 11*a*, 11*b* and 11*c* are also views respectively similar to those of FIGS. 9*a*, 9*b* and 9*c*, of yet another embodiment of the invention wherein the lower jaw is not pivotable, and including separate releasing controls for the upper drawings jaws;

FIG. 12 is a sectional view of a modified form of the lower jaw, which is adjustable in height; and FIGS. 13*a* and 13*b* are diagrammatic views, respectively, in section and in plan of a drawing jaw vise with three mutually adjacent drawing jaws of which the middle jaw is stationary and both of the other drawing jaws are displaceable within a wedging path on wedge rails.

Referring now to the drawing and, first, particularly, to FIG. 1 thereof, there is shown a drawing jaw vise 1 having a lower wall 2 extending parallel to the direction of drawing represented by the arrow 3. With the interposition of bearing rollers 4, the lower drawing jaw 5 within the clamping or wedge path has a slight shiftability or mobility opposite to the drawing direction of the arrow 3. The material to be drawn is disposed on the lower drawing jaw. The upper wall 7 of the drawing jaw vise 1 is inclined wedge-shaped opposite to the drawing direction represented by the arrow 3. With the intermediary or interposition of bearing rollers 8, the upper drawing jaw 9 is shiftable parallel to the wedge wall 7 within the confines or framework of the clamping path. A control cylinder 10 serves to release the drawing jaw movements.

Figure 2:
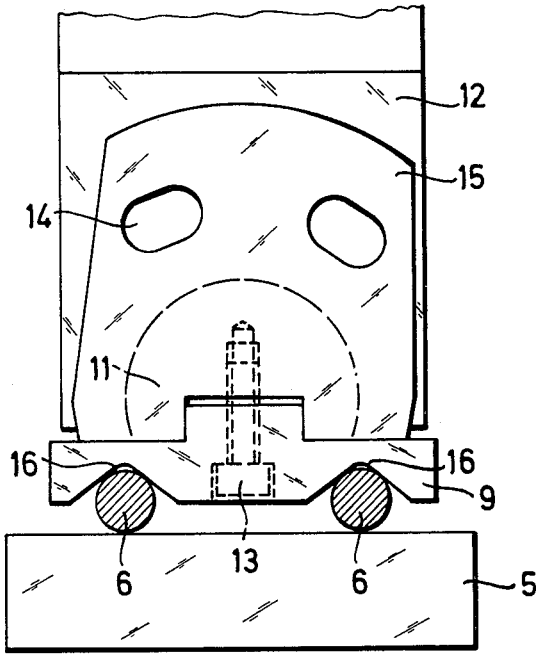
FIG. 2 is an enlarged fragmentary diagrammatic view of the lower flat drawing jaw and the upper rotating drawing jaw having shaped construction accommodated to the profile of the elongated material to be drawn.

In FIG. 2, there is shown material 6 to be drawn which is formed of two strands or bars which are simultaneously drawn and, consequently, are simultaneously gripped by the drawing jaws 5 and 9. The upper drawing jaw 9 has a roller-shaped, bearing part 11 flattened at the underside thereof and pivotable in a holder 12 about an axis parallel to the direction of drawing. The bearing part 11 is provided, at the underside thereof, with an enlargement or widening for gripping both bars 6. The widening is a separate member and is threadedly fastened to the flat underside of the roller-shaped bearing member 11 by means of screws 13. Slots 14 serve, by means of screws, to threadedly fasten a holder member 15, as desired, more or less tightly.

This is of importance if one wishes to impart a given resistance impedence to the pivotability of the drawing jaws 9.

The drawing jaw 9 is mounted as a scale-beam, and differences in cross section of the rods or strands 6 can be equalized. The drawing jaw 9 has shaped constructions 16 accommodated to the profile or cross section of the bars 6. The location of the rods 6 during the drawing operation is therefore fixed, and the specific pressure, which is exerted upon the surface of the rods 6 during the drawing operation is minimized. With an adequate length of the drawing jaws 5 and 9, the specific pressure can be kept so small that no damage is caused to the surface of the material to be drawn.

By drawing two rods or strands simultaneously, the production capacity is approximately doubled.

The drawing jaws 5 and 9 are set out for adjacently traveling rods or strands 6. The drawing jaws 5 and 9 are disposed one above the other.

Each of the drawing jaws 5 and 9 that are disposed above one another is common to both rods or strands 6.

Figure 3:
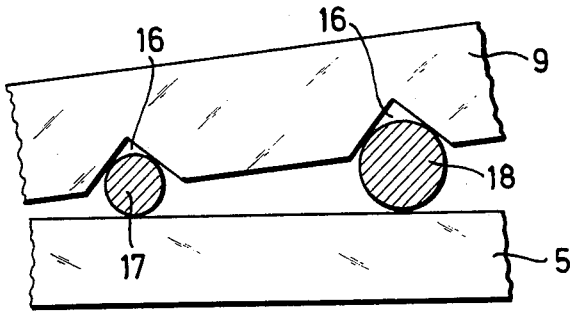
FIG. 3 is a fragmentary view of FIG. 2 modified to accommodate elongated drawable material of different thicknesses yet having an upper drawing jaw with correspondingly similar shaped structures.

In FIG. 3, a corresponding construction of the drawing jaws 5 and 9 is shown, however, with rods or strands 17 and 18 of the material to be drawn that are of different thickness. Slight differences in the thickness of the rods or strands 17 and 18 can be equalized or balanced by the scale-beam or balance-beam mounting of the drawing jaw 9. In this regard, the shaped constructions 16 can remain unchanged.

Figure 4:
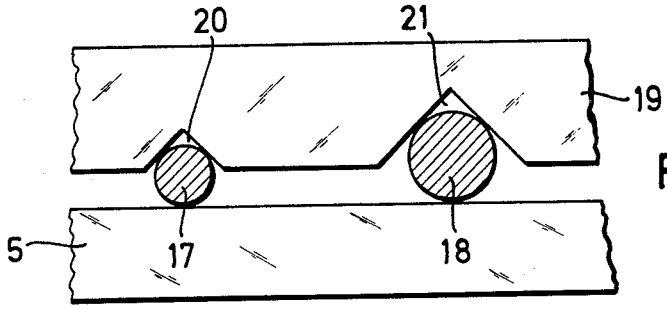
FIG. 4 is a view similar to that of FIG. 3 wherein the material to be drawn are of unequal thickness, and the shaped constructions at the upper drawing jaw are of unequal size.

Another possible embodiment of the drawing jaws 5 and 9 is shown in FIG. 4. Shaped constructions 20 and 21 of unlike size in the drawing jaw 19 correspond to the unequally thick strands or bars 17 and 18. This type of construction is primarily of importance if the relative difference in the thickness of the strands or bars 17 and 18 is very great. For a greater diameter than shown for the bar 18, the drawing jaw 19 can assume a position such as that of the drawing jaw 9 of FIG. 4 due to the balance-beam or scale-beam mounting thereof.

Figure 5:
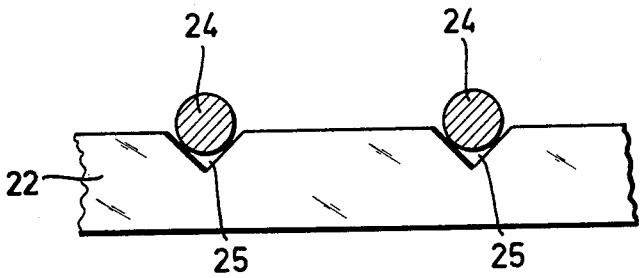
FIG. 5 is a fragmentary view of a lower drawing jaw with shaped constructions.

According to FIG. 5, the shaped constructions 25 for the bars or strands 24 can be provided in the lower drawing jaw 22. FIG. 5 shows an embodiment for solid material to be drawn.

Figure 6:
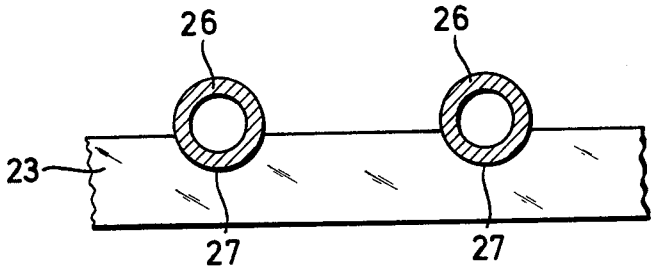
FIG. 6 is a view similar to that of FIG. 5 of a modified form of lower drawing jaw accommodated for tubular material.

FIG. 6 shows shaped constructions 27 for tubular strands or bars 26 in the lower drawing jaw 23. With tubular strands or rods, the formed constructions are provided for a real support, whereas, for solid material, linear supports are possible. This applied in general also to the constructions according to FIGS. 2, 3 and 4. For tubular material, the formed constructions must correspondingly be accommodated or matched also in these cases. Just such a measure is recommended for material of softer characteristic or property, such as copper, for example.

Figure 7:
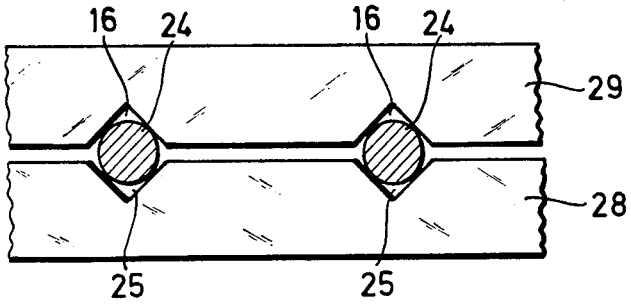
FIG. 7 is a view similar to those of FIGS. 3 and 4 of a modified form of the device of the invention, wherein both lower and upper jaws have shaped constructions.
Figure 8:
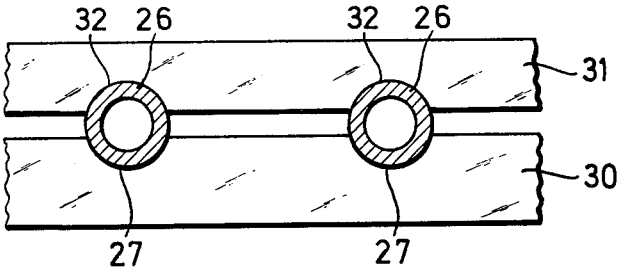
FIG. 8 is a view like that of FIG. 7 wherein both lower and upper jaws have shaped constructions that are, however, for tubular material.

According to FIGS. 7 and 8, shaped constructions 25, 27, as well as 16, 32 are respectively provided in the lower drawing jaw 28, 30, as well as in the upper drawing jaw 29, 31. In this regard, the strand or rod material 24 is taken to be solid material, and the strand or rod material 26 tubular material. The shaped constructions should be complementary, respectively, above and below. The shaped constructions can also be different above and below and, nevertheless, complementary. Shaped constructions both in the upper as well as in the lower drawing jaw increase the supporting surface and provide therewith gentle handling of the surface of the material to be drawn. Under certain circumstances, because of the greater supporting surface, the drawing jaw can also be shortened in the length thereof without exceeding the permissible specific bearing pressure.

According to FIGS. *9a*, *9b* and *9c*, the balanced mounting can be provided also for the lower drawing jaw 33. The lower drawing jaw 33 exhibits, in this regard, a pivotal flat circular cylindrical section 34 having a width at the top thereof adequate for clamping both rods or strands 35 and 36. A releasing control with a control cylinder 10 acts upon the upper drawing jaw 37 for displacing the upper drawing jaw 37 within the clamping path on a wedge path or track parallel to the housing wall 7.

In the views according to FIGS. 10*a*, 10*b* and 10*c*, the lower drawing jaw 33 with the circular cylindrical section 34 corresponds to that shown in FIGS. *9a*, *9b* and *9c*. The upper drawing jaw 38, 39 is divided. Both parts thereof are actuated by a single releasing control with the control cylinder 10 and, in fact, through the hinged bracket 40.

In the embodiment of FIGS. 11*a*, 11*b* and 11*c*, the lower drawing jaw 5 is not pivotable. The divided upper drawing jaw 38, 39 cooperates with two hinged brackets 41, 42 and is controlled separately by the control cylinder 10', 10''. According to FIG. 12, the lower drawing jaw is adjustable in the elevation thereof and assembled of two parts 43, 44 which are slidingly adjustable on one another with the wedge surface 45 thereof. The screw 46 serves for effecting the adjustment and has an adequate free space provided therefor in the member 44 for effecting the adjustment in elevation. Due to the elevational adjustability, an accommodation to the dimensions of the respective materials to be drawn is able to be effected: Elevational adjustment of the drawing dies can thereby be avoided. The elevational adjustment of the lower drawing jaw is simpler than that of the drawing dies. The inventive feature of the elevational adjustability of the lower drawing jaw can also be used for carriage drawing machines that are provided only for simultaneous drawing of a strand or rod. This feature is inventive also with respect to this carriage drawing machine.

According to FIGS. 13*a* and 13*b*, the drawing jaws 48, 49 are disposed adjacent one another with a stationary drawing jaw 47 interposed. The drawing jaws 48, 49 are displaceable on the wedge paths 52, 53 within the clamping path. Also in this embodiment of the invention, the strands or bars 50, 51 that are to be drawn are disposed adjacent one another.

The features of the invention are advantageously applicable not only for round solid and tubular material, but also for profile or sectional material, such as hexagonal, tape or band, flat and trapezoidal material and the like. The drawing jaws are then, advantageously, to be provided wth corresponding shaped constructions.

There are claimed:

1. In a carriage drawing machine for uniformly drawing elongated material to be drawn, having two drawing carriages reciprocatingly displaceable in mutually opposite directions, a drawing jaw vise on each carriage for alternately gripping the material to be drawn, each of the vises having two drawing jaws held in a housing by a wedge structure with bearing rollers interposed which serves to self-lock during the drawing, both of said drawing jaw vises being disposed to receive and simultaneously draw two bars of the material to be drawn, at least one of said two drawing jaws being engageable in common with both of the bars, and including an equalizing support in association with the other of said two drawing jaws.

2. Carriage drawing machine according to claim 1 wherein said drawing jaws are disposed relative to one another for accommodating adjacently traveling rods of the material to be drawn.

3. Carriage drawing machine according to claim 2 wherein said drawing jaws are disposed one above the other for cooperatively gripping the material to be drawn.

4. Carriage drawing machine according to claim 1 wherein at least one of the sides of the cooperating drawing jaws facing toward one another has shaped constructions accommodated to the profile of the rods.

5. Carriage drawing machine according to claim 1 wherein said drawing jaws for both of the rods are disposed one above the other, and each thereof is engageable in common with both of the rods, one of said drawing jaws having a scale-beam mounting and having an axis extending in a direction parallel to the direction of the drawing.

6. Carriage drawing machine according to claim 1 wherein said drawing jaws are disposed one above the other, one of said drawing jaws being divided for the rods of material to be drawn.

7. Carriage drawing machine according to claim 1 wherein said drawing jaws are disposed one above the other, and within a clamping path during take-over of the material to be drawn, the lower drawing jaw being displaceable parallel to the direction of drawing and the upper drawing jaw parallel to a wedge wall of said housing of said drawing jaw vise.

8. Carriage drawing machine according to claim 1 wherein said drawing jaws are disposed one above the other, the upper drawing jaw having a roller-shaped flat bearing member at the underside thereof, said bearing member being pivotable in a holder about an axis parallel to the direction of drawing, said bearing member having a widening at the underside thereof for gripping both of the bars of material to be drawn.

9. Carriage drawing machine according to claim 8 wherein said widening is constructed as a separate member threadedly secured to the flat underside of said roller-shaped bearing member.

10. Carriage drawing machine according to claim 1 wherein said drawing jaws are disposed one above the other, the lower drawing jaw being constructed as a flat circular cylindrical section pivotable in a bearing trough about an axis parallel to the direction of drawing and having a width at the top thereof adequate for gripping both of the bars of material to be drawn.

11. Carriage drawing machine according to claim 7 wherein said lower drawing jaw is adjustable in elevation.

12. Carriage drawing machine according to claim 1 wherein said vises, respectively, have a third drawing jaw fixedly disposed intermediate the other two drawing jaws, said other two drawing jaws being displaceable within a clamping path on respective wedge paths.

13. Carriage drawing machine according to claim 4 wherein both of the sides of the cooperating drawing jaws facing towards one another are formed with rod-accommodating shaped constructions mutually complementing one another.

14. Carriage drawing machine according to claim 13 wherein said shaped constructions in both of the drawing jaws differ from one another.

* * * * *